US006866726B1

(12) United States Patent
Suzuki et al.

(10) Patent No.: US 6,866,726 B1
(45) Date of Patent: Mar. 15, 2005

(54) NON-AUSTEMPER TREATED SPHEROIDAL GRAPHITE CAST IRON

(75) Inventors: Katsumi Suzuki, Kakegawa (JP); Noriyuki Nakajima, Ogasa-gun (JP); Yoshio Ohba, Fukuroi (JP); Takahiro Ono, Ogasa-gun (JP)

(73) Assignee: Asahi Tec Corporation (JP)

( * ) Notice: Subject to any disclaimer, the term of this patent is extended or adjusted under 35 U.S.C. 154(b) by 104 days.

(21) Appl. No.: 10/009,309

(22) PCT Filed: Jun. 7, 2000

(86) PCT No.: PCT/JP00/03700

§ 371 (c)(1),
(2), (4) Date: Jan. 2, 2002

(87) PCT Pub. No.: WO00/75387

PCT Pub. Date: Dec. 14, 2000

(30) Foreign Application Priority Data

Jun. 8, 1999 (JP) ..... 11-160313

(51) Int. Cl.[7] ..... C22C 37/00
(52) U.S. Cl. ..... 148/321; 420/27
(58) Field of Search ..... 148/321; 420/27, 420/13

(56) References Cited

U.S. PATENT DOCUMENTS 3,891,432 A * 6/1975 Nake et al. ..... 420/30
4,484,953 A 11/1984 Kovacs et al. ..... 148/3
4,572,751 A * 2/1986 Oguri et al. ..... 148/321
4,889,687 A 12/1989 Ishihara et al.
4,990,194 A 2/1991 Obata et al. ..... 148/3
5,551,995 A 9/1996 Nagayoshi ..... 148/321

FOREIGN PATENT DOCUMENTS

JP 61-288011 12/1986
JP 363011649 A * 1/1988 ..... C22C/37/04
JP 364000245 A * 1/1989 ..... C22C/37/04
JP 405125480 A * 5/1993 ..... C22C/37/04
JP 8-41581 2/1996
JP 08-333650 12/1996
JP 409067640 A * 3/1997 ..... C22C/37/04
JP 09-125189 5/1997
JP 09-217142 8/1997
JP 11-006026 1/1999

* cited by examiner

*Primary Examiner*—Deborah Yee
(74) *Attorney, Agent, or Firm*—Parkhurst & Wendel, L.L.P.

(57) ABSTRACT

A non-austemper-treated spheroidal graphite cast iron obtainable without being subjected to an austemper treatment. The non-austemper-treated spheroidal graphite cast iron has a tensile strength of 650–850 MPa and an elongation of 7.0–14.5%. In the non-austemper-treated spheroidal graphite cast iron, V-notch material has a fatigue limit of 290 MPa or more. The non-austemper-treated spheroidal graphite cast iron has well-balanced mechanical properties both in tensile strength and elongation and improved tensile strength and elongation than conventional one.

10 Claims, 10 Drawing Sheets

NON-AUSTEMPER TREATED SPHEROIDAL GRAPHITE CAST IRON

TECHNICAL FIELD

The present invention relates to a non-austemper-treated spheroidal graphite cast iron obtainable without being subjected to an austemper treatment.

BACKGROUND ART

As cast iron, there has been known spheroidal graphite cast iron in which graphite has a spheroidal shape. The spheroidal graphite cast iron has a tensile strength within a range of from 400 to 800 MPa, and has a tendency to decrease elongation when the tensile strength is increased and to decrease tensile strength when elongation is increased.

Recently, in a field of automobile parts or the like, where lightening is strongly required, spheroidal graphite cast iron having well-balanced mechanical properties both in tensile strength and elongation has been required. As spheroidal graphite cast iron having such mechanical properties, the following spheroidal graphite cast iron has been known.

One is a bainite spheroidal graphite cast iron obtained by heating a casting at a temperature (about 800–950° C.) for austenitizing, quenching the casting in a salt bath furnace at about 300–400° C., retaining the casting at a constant temperature in the furnace, and taking out the casting from the furnace. Another example is a bainite spheroidal cast iron obtained by adding 1–4% by mass of Ni and 0.5–1.0% by mass of Mo thereto and not subjecting to a heat treatment under a condition of, so-called, as cast.

However, in the former bainite spheroidal graphite cast iron, a sufficient bainite structure can not be attained in the case of heavy thickness products. Therefore, it is used to be adopted for a thin product. Even in this case, there is caused a problem of strain due to a thermal treatment, or a high cost due to a heat treatment using a salt bath furnace. The latter bainite spheroidal graphite cast iron has a problem of cost-increase because expensive Mo is added thereto.

If the aforementioned bainite spheroidal graphite cast iron is subjected to molten-zinc plating (for example, holding in zinc melt for 120 seconds at 460° C.) to give corrosion resistance, the bainite spheroidal graphite cast iron has a defect of decrease in tensile strength and elongation due to the heat treatment as shown in the following Table 1.

TABLE 1

| Tensile strength (MPa) | Elongation (%) | Organization | Thermal treatment, molten-zinc plating treatment |
|---|---|---|---|
| 1150 | 12.0 | Bainite | Thermal treatment only |
| 850 | 4.0 | Bainite | Molten-zinc plating treatment after thermal treatment |

Table 1 shows influence of heat (about 460° C.) on spheroidal graphite cast iron having bainite structure. Here, "thermal treatment" means holding at 900° C. for one hour and then at 380° C. for one hour, and "molten-zinc plating treatment" means holding at 460° C. for 120 seconds.

Therefore, the present invention has been made in view of the above conventional problems, and an object of the present invention is to provide a high strength and ductility spheroidal graphite cast iron having well-balanced mechanical properties both in tensile strength and elongation and having improved tensile strength and elongation than conventional one.

Another object of the present invention is to provide spheroidal graphite cast iron which is not decreased in mechanical properties even if it is subjected to a treatment such as hot dipping and which has improved tensile strength and elongation without adding Mo thereto.

The other object of the present invention is to provide a non-austemper-treated spheroidal graphite cast iron obtained without being subjected to an austemper treatment where the material is heated at a temperature for austenitizing, and then quenched at about 300–400° C., retaining the casting at a constant temperature.

DISCLOSURE OF INVENTION

According to the present invention, there is provided a non-austemper-treated spheroidal graphite cast iron obtainable without being subjected to an austemper treatment, wherein the non-austemper-treated spheroidal graphite cast iron has a tensile strength of 650–850 MPa and an elongation of 7.0–14.5%.

According to the present invention, there is further provided a non-austemper-treated spheroidal graphite cast iron obtainable without being subjected to an austemper treatment, wherein V-notch test piece has a fatigue limit of 290 MPa or more.

The non-austemper-treated spheroidal cast iron preferably contains 0.05–0.45% by mass of Mn, and in this case the non-austemper-treated spheroidal cast iron preferably contains 2.0–4.0% by mass of Ni.

Further, the non-austemper-treated spheroidal cast iron preferably has a Brinell hardness of 230–285 HB and a flank wear of 0.13 mm or less in a cutting distance of 1.7 km.

BRIEF DESCRIPTION OF DRAWINGS

FIG. 8(*a*) is a graph showing tensile properties before the plating treatment, and FIG. 8(*b*) is a graph showing tensile properties after the plating treatment.

BEST MODE FOR CARRYING OUT THE INVENTION

Figure 1:
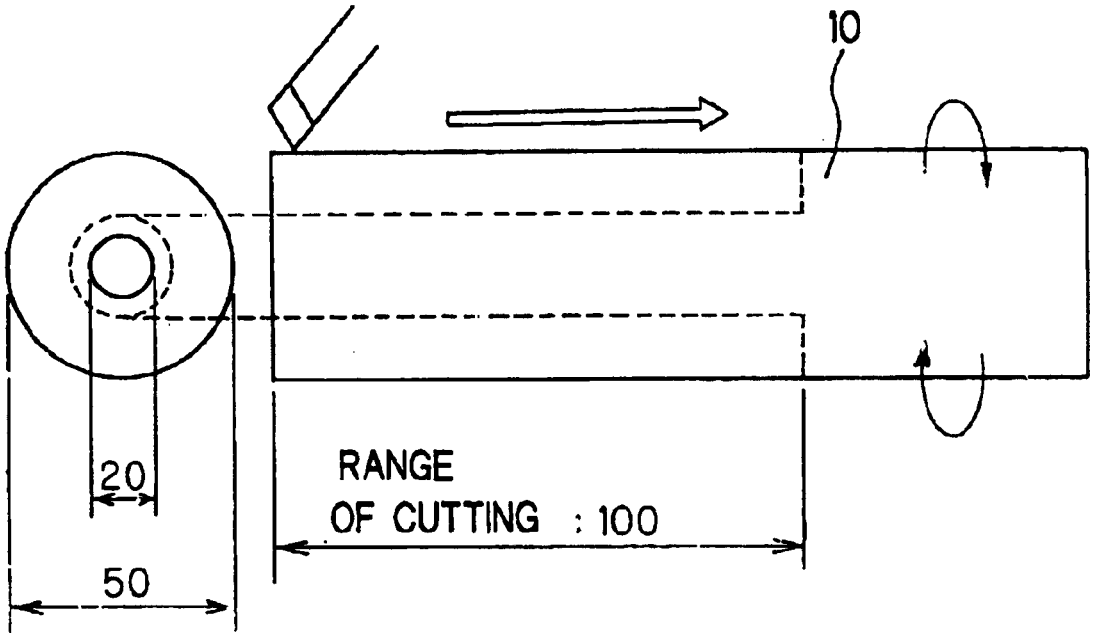
FIG. 1 is an explanatory view showing a shape of a cutting test piece.

The present invention is hereinbelow described in detail.

The present invention relates to a high strength and ductility spheroidal graphite cast iron obtainable without being subjected to an austemper treatment which has conventionally been conducted. Specifically, the spheroidal graphite cast iron has a tensile strength of 650–850 MPa and an elongation of 7.0–14.5%. The mechanical properties of both tensile strength and elongation are well balanced, and the tensile strength and the elongation are improved in comparison with a conventional spheroidal graphite cast iron.

Such a high strength and ductility non-austemper-treated spheroidal graphite cast iron has larger tensile strength and elongation than predetermined values without being subjected to a heat treatment. Further, even if the cast iron is subjected to hot dipping or the like, mechanical properties thereof are not deteriorated.

A non-austemper-treated spheroidal graphite cast iron of the present invention has a tensile strength of 650–850 MPa, preferably 700–850 MPa, more preferably 750–850 MPa, and an elongation of 7.0–14.5%, preferably 9.5–14.5%, more preferably 12.0–14.5%.

Here, mechanical properties of tensile strength and elongation of spheroidal graphite cast iron were obtained according to a test method prescribed by JIS Z 2201.

The aforementioned non-austemper-treated spheroidal graphite cast iron of the present invention preferably contains 0.05–0.45% by mass of Mn as a component, and more preferably 0.10–0.35% by mass of Mn. A correlation between tensile strength and elongation of the spheroidal graphite cast iron can be controlled by changing an added amount of Mn. That is, if a Mn content is decreased, the tensile strength is lowered, while the elongation is improved. On the other hand, if a Mn content is increased, the tensile strength is improved, while the elongation is decreased. If a Mn content exceeds 0.45% by mass, it becomes too hard, and the elongation falls below 7.0%. Incidentally, Mn inevitably gets mixed from the material or in a production process, and it is difficult in point of present technique to lower the content below 0.05% by mass. As another component, 2.0–4.0% by mass of Ni is preferably contained. When a Ni content is out of the above range, elongation tends to decrease.

Incidentally, the other components of a non-austemper-treated spheroidal graphite cast iron of the present invention are not particularly limited. However, it is preferable that the non-austemper-treated spheroidal graphite cast iron includes 3.1–4.0% by mass of C, 1.8–3.0% by mass of Si, 0.05% by mass or less of P, 0.02% by mass or less of S, and 0.02–0.06% by mass of Mg. The reason is as follows:

(1) If the C content is below 3.1% by mass, carbide is formed and elongation is remarkably reduced. If the C content is above 4.0% by mass, carbon floatation causes deterioration in tensile strength.

(2) If the Si content is below 1.8% by mass, carbide is formed and elongation is remarkably reduced. If the Si content is above 3.0% by mass, carbon floatation causes deterioration in tensile strength.

(3) If the P content is above 5% by mass, a steadite phase is formed, and it becomes brittle.

(4) If the S content is above 0.02% by mass, MgS is formed upon a Mg treatment, a dissolved Mg amount decreases to disturb spheroidizing of graphite, and slag is increased. Therefore, it is not preferable.

(5) If the Mg content is below 0.02% by mass, graphite cannot be spheroide, and tensile strength cannot be ensured. If the Mg content is above 0.06% by mass, carbide is prone to be formed, and a Mg alloy upon a treatment is expensive. Therefore, it is not preferable.

A non-austemper-treated spheroidal graphite cast iron has a property of a fatigue limit of V-notch material of 290 MPa or more. It can be considered the fatigue limit becomes higher than predetermined level even in V-notch material because spheroidal graphite cast iron is particularly excellent in an elongation property as described above.

Further, a non-austemper-treated spheroidal graphite cast iron of the present invention is excellent machinability. If a flank wear in the case that a cutting test is performed is used as an index showing machinability, spheroidal graphite cast iron of the present invention has a flank wear of 0.13 mm or less in a cutting distance of 1.7 km.

Cutting conditions for the cutting test were a cutting speed of 100 m/min, transmission rate of 0.2 mm/rotation, and a cut of 1.5 mm to 10 cutting test pieces having a shape shown in FIG. 1. A dry cutting was performed by the use of UC6010 produced by Mitsubishi Material as a cutter.

Further, spheroidal graphite cast iron of the present invention has a hardness of 230–285 HB, preferable 235–280 HB, and more preferably 240–275 HB with showing high hardness. Thus, spheroidal graphite cast iron of the present invention has hardness above a predetermined one, and hardness is well balanced with strength and tenacity.

Here, the spheroidal graphite cast iron was measured for Brinell hardness by a method prescribed in JIS Z2245.

The aforementioned spheroidal graphite cast iron of the present invention may be produced by conventionally known steps.

An example of steps of producing cast iron is described. Various kinds of iron alloys such as pig iron and steel scrap from a material yard are combined in consideration of contents of blended components to obtain a material. A cast iron molten metal is produced by using an electric furnace (low-frequency furnace or high frequency furnace) or a cupola. The molten metal having an aimed composition is subjected to a molten metal treatment in a ladle using a graphite globurization agent. At this time, inoculation may be added as necessary.

After the spheroidizing of the molten metal, the molten metal is poured into a mold molded by a molding machine from the ladle to be cast for solidification and cooling as it is in the mold. Alter an article in the mold is cooled, decomposition of the mold is performed by a shake-out machine to separate the article from molding sand. The article is cooled by a drum cooler, and then sand adhering to the surface of the article is removed by a shot blast to be subjected to fettling. In this fettling step, finishing such as a dam and deburring is performed to obtain a product of cast iron casting.

Among the above steps, in inoculation performed in a holding furnace and a molten metal treatment for spheroidizing, a desired spheroidal graphite cast iron can be produced by adjusting kind and amount of materials to be added thereto. In the present invention, a high strength ductile non-austemper-treated spheroidal graphite cast iron having well-balanced and high mechanical properties of tensile strength and elongation and in comparison with conventional ones can be obtained by controlling amounts of Mn and Ni to be predetermined ones as components and controlling cooling speed after a molten metal is poured into a mold in various methods except for a conventionally known austemper treatment.

That is, in the present invention, cooling speed is controlled after spheroidal graphite cast iron molten metal prepared so as to have an aimed composition as a method. Modes for such a method are as follows:

(1) Representatively, natural cooling (as cast) is performed in a mold when a product has a thickness of about 25–50 mm.

(2) A thin product, for example, a product having a thickness of 10 mm or less is cooled down too quickly, and therefore, cast iron having predetermined mechanical properties as in the present invention can not be obtained. Therefore, the cooling speed should be controlled by keeping the mold warm (selecting a mold material which is hard to be cooled, collecting a series of molds together, heating a mold, or the like) to give almost the same cooling process for a product having a thickness of about 25–50 mm.

(3) After the knock-out of the mold, cooling speed is controlled with heating the product to give almost the same cooling process for a product having a thickness of about 25–50 mm in the same manner as the above (2).

To sum up, in a method of the present invention, cooling speed is controlled by gradually cooling continuously after casting or heating after cooling down to about a constant temperature after casting and then cooling with heating without a quenching operation from a temperature for austenitizing to about 300–400° C. such as a conventionally known austemper treatment. In view of the difference in cooling speed depending on a thickness of a product (A thin one is cooled quickly, while a thick one is cooled slowly.), cooling speed is controlled to obtain strong and tenacious spheroidal graphite cast iron having well-balanced mechanical properties of both tensile strength and elongation.

The present invention is hereinbelow described more specifically on the basis of Examples.

EXAMPLE 1

In accordance with a conventionally known production steps of cast iron, molten metal of spheroidal graphite cast iron was prepared.

That is, cast iron materials were blended to prepare molten metal of spheroidal graphite cast iron having an adjusted chemical composition of 3.55% by mass of C, 2.50% by mass of Si, 0.29% by mass of Mn, 0.18% by mass of P, 0.07% by mass of S, 0.039% by mass of Mg, 0.036% by mass of Cr, 0.08% by mass of Cu, and 3.1% by mass of Ni.

Figure 2:
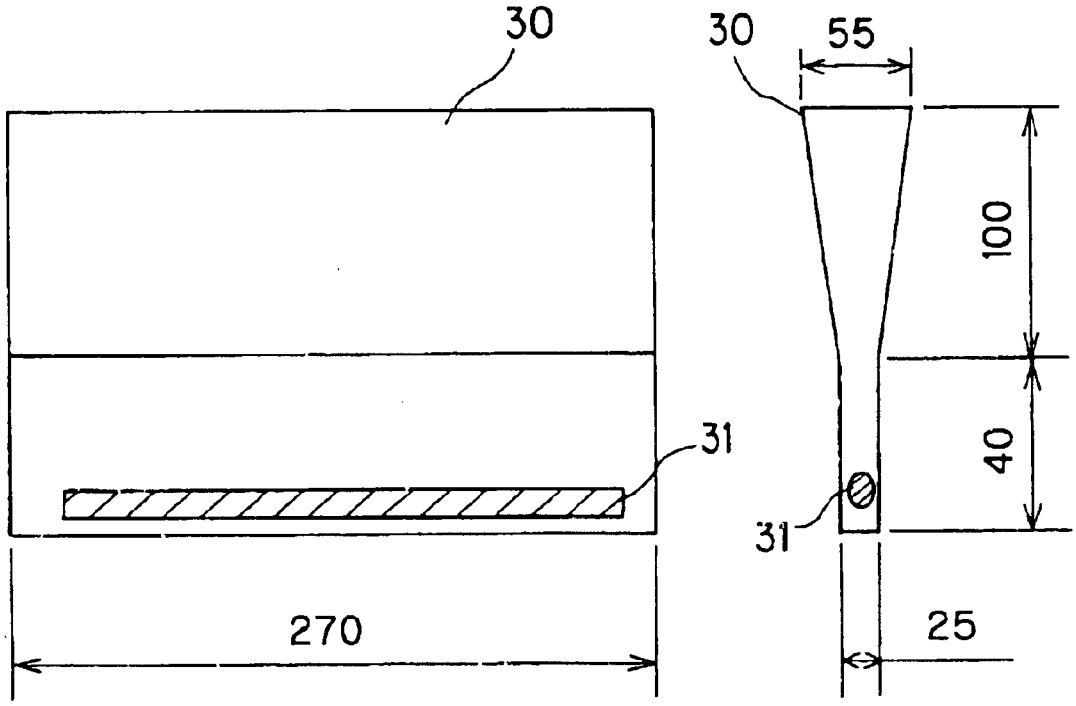
FIG. 2 is an explanatory view showing a shape of a Y-shaped test material (JIS B size).

The molten metal of spheroidal graphite cast iron was poured into a mold for Y-shaped test material (JIS B size) 30 shown in FIG. 2 at about 1400° C. and subjected to natural cooling (as cast) to a constant temperature in the mold.

Figure 4:
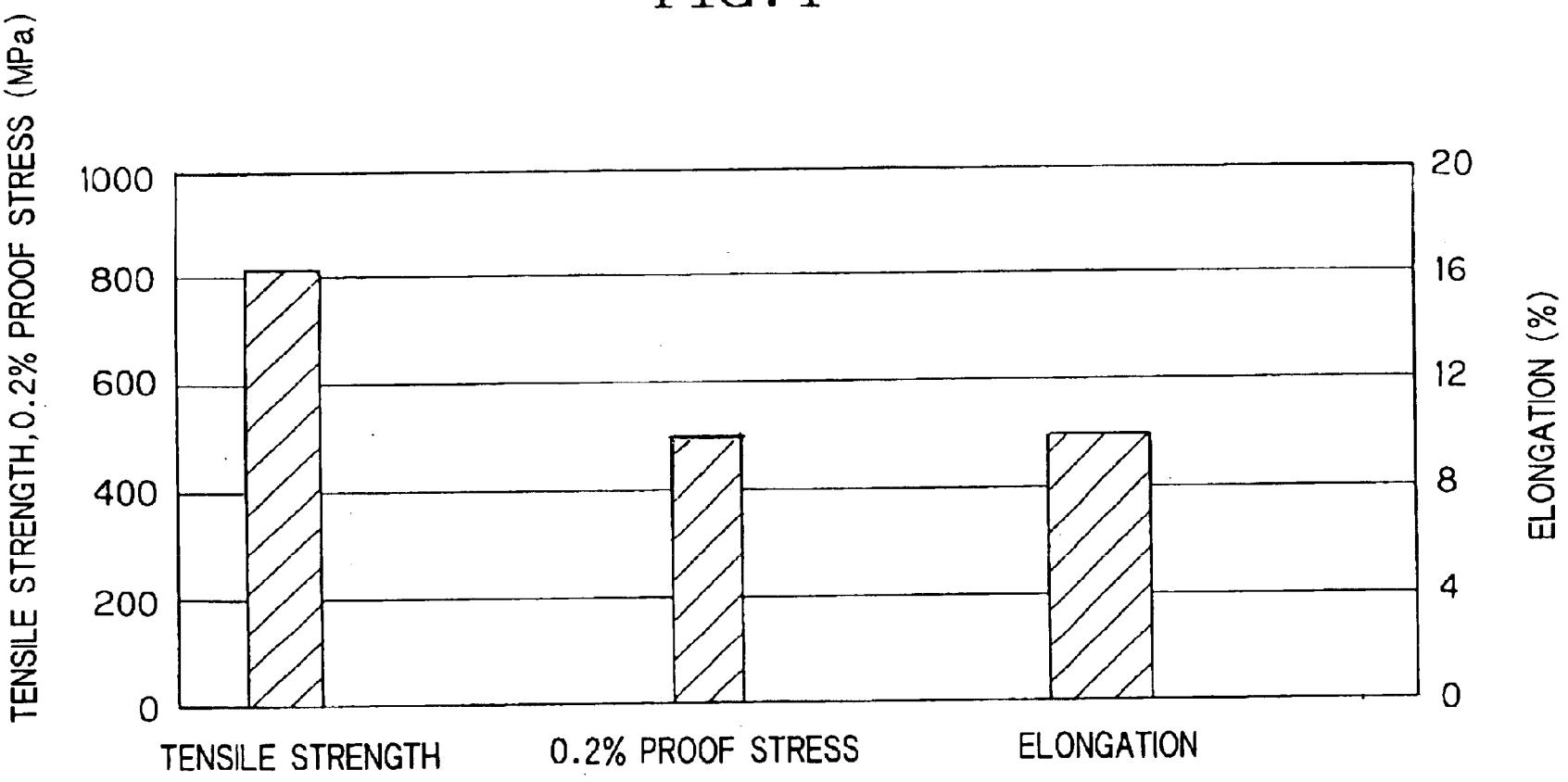
FIG. 4 is a graph showing tensile properties (tensile strength, 0.2% proof stress and elongation).

A test piece was taken from the lower portion 31 of the Y-shaped test material (B size) 30 (JIS G 5502). Tensile properties (tensile strength, 0.2% proof stress and elongation) were obtained by using No. 4 test piece of JIS Z 2201. The results are shown in FIG. 4.

Figure 3:
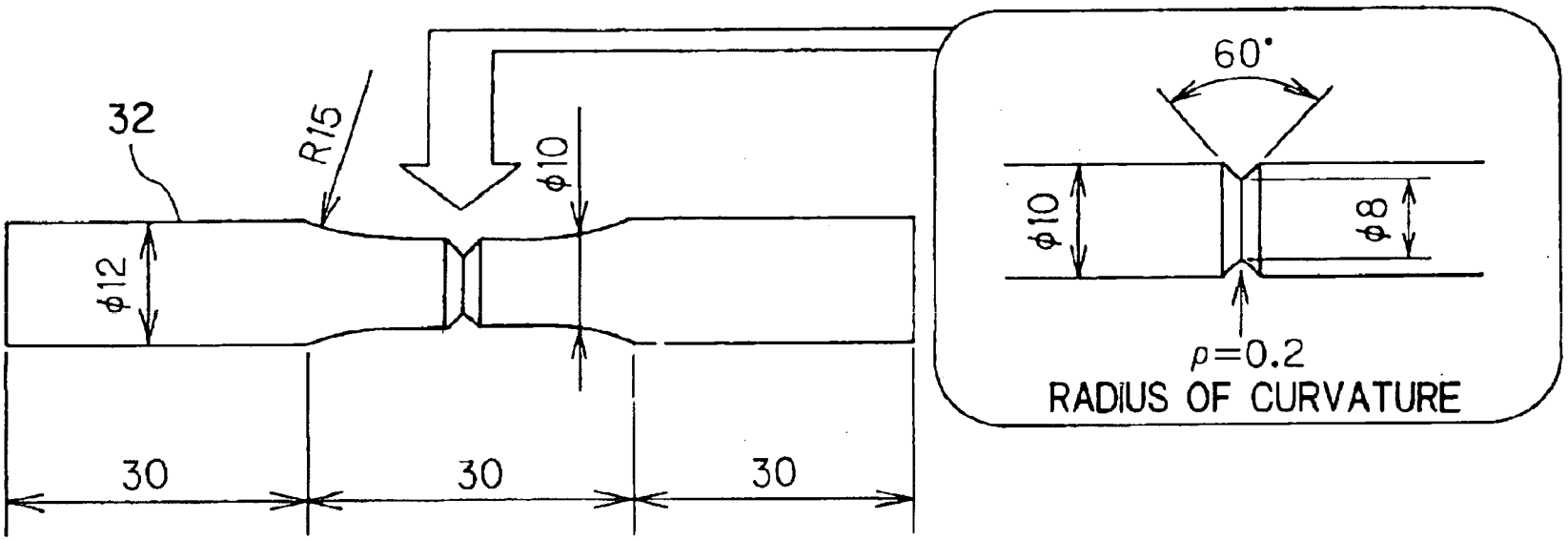
FIG. 3 is an explanatory view showing a shape and a size of V-notch material used for a rotary bending fatigue test.

Further, a V-notch material 32 shown in FIG. 3 was taken from the Y-shaped test material (B size) 30 and subjected to a rotary bending fatigue test to obtain a fatigue limit.

Figure 5:
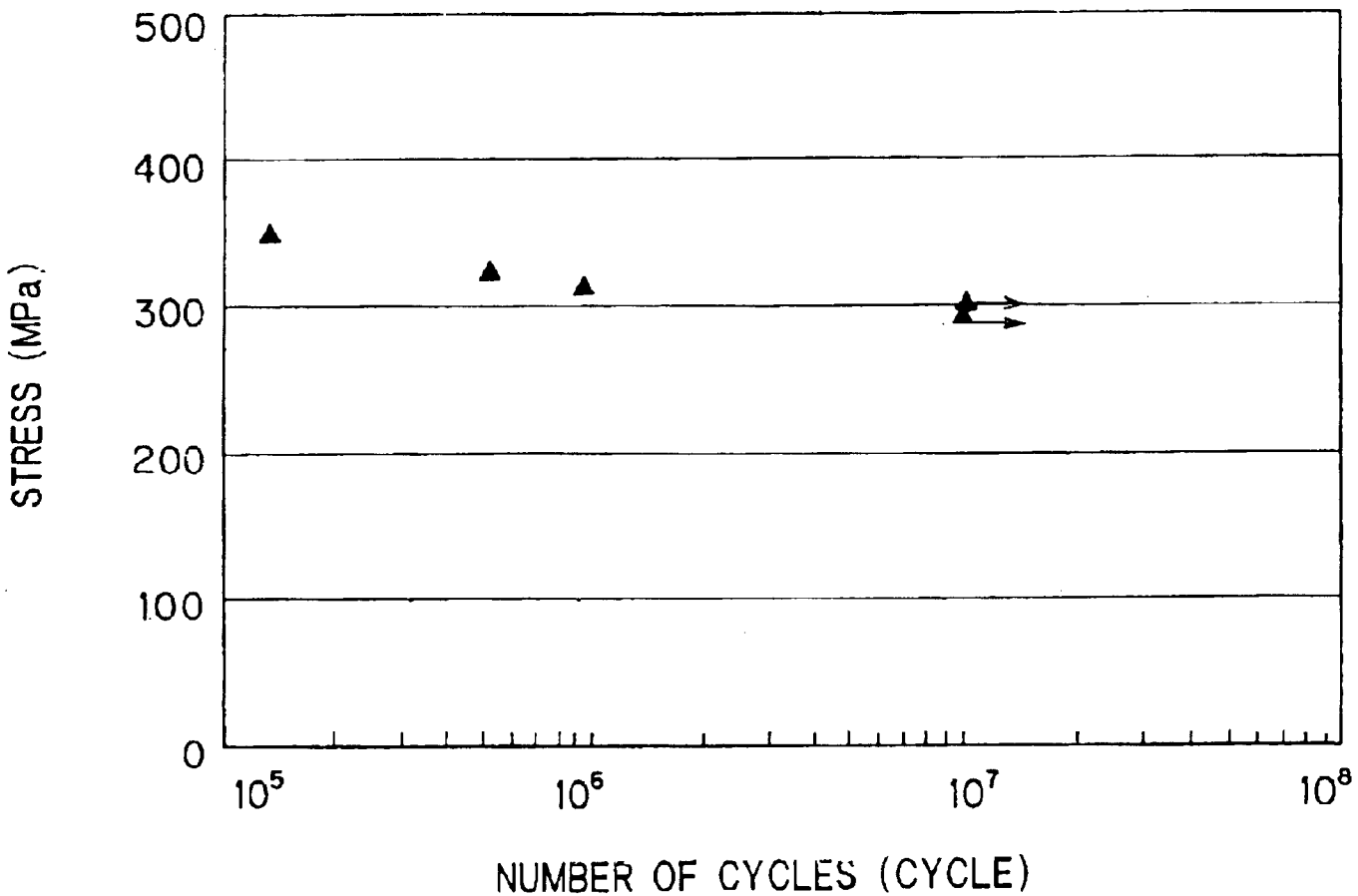
FIG. 5 is a graph showing fatigue limit in Example 1.

In the rotary bending fatigue test, stress was applied with rotating the V-notch material 32 at 2500 rpm in the atmosphere at room temperature using the Ono-style rotary bending fatigue test-machine on the basis of JIS Z 2274 so as to measure a fatigue limit from a correlation between stress and repeated number until the test piece was broken. The results are shown in FIG. 5.

EXAMPLE 2

A cutting test piece 10 of spheroidal graphite cast iron having a shape shown in FIG. 1 was taken in the same manner as in Example 1. The cutting test piece 10 was subjected to a cutting test to be measured for flank wear. The cutting test piece had a flank wear of 0.12 mm or less in a cutting distance of 1.7 km.

On the other hand, a conventional spheroidal graphite cast iron (corresponding to FEC700) (composition: 3.6% by mass of C, 2.5% by mass of Si, 0.4% by mass of Mn, 0.03% by mass of P, 0.03% by mass of S, 0.03% by mass of Mg, 0.8% by mass of Cu, and the rest of Fe) had a flank wear of 0.16 mm. Thus, it was found that spheroidal graphite cast iron of the present invention is excellent in workability.

EXAMPLE 3

Figure 6:
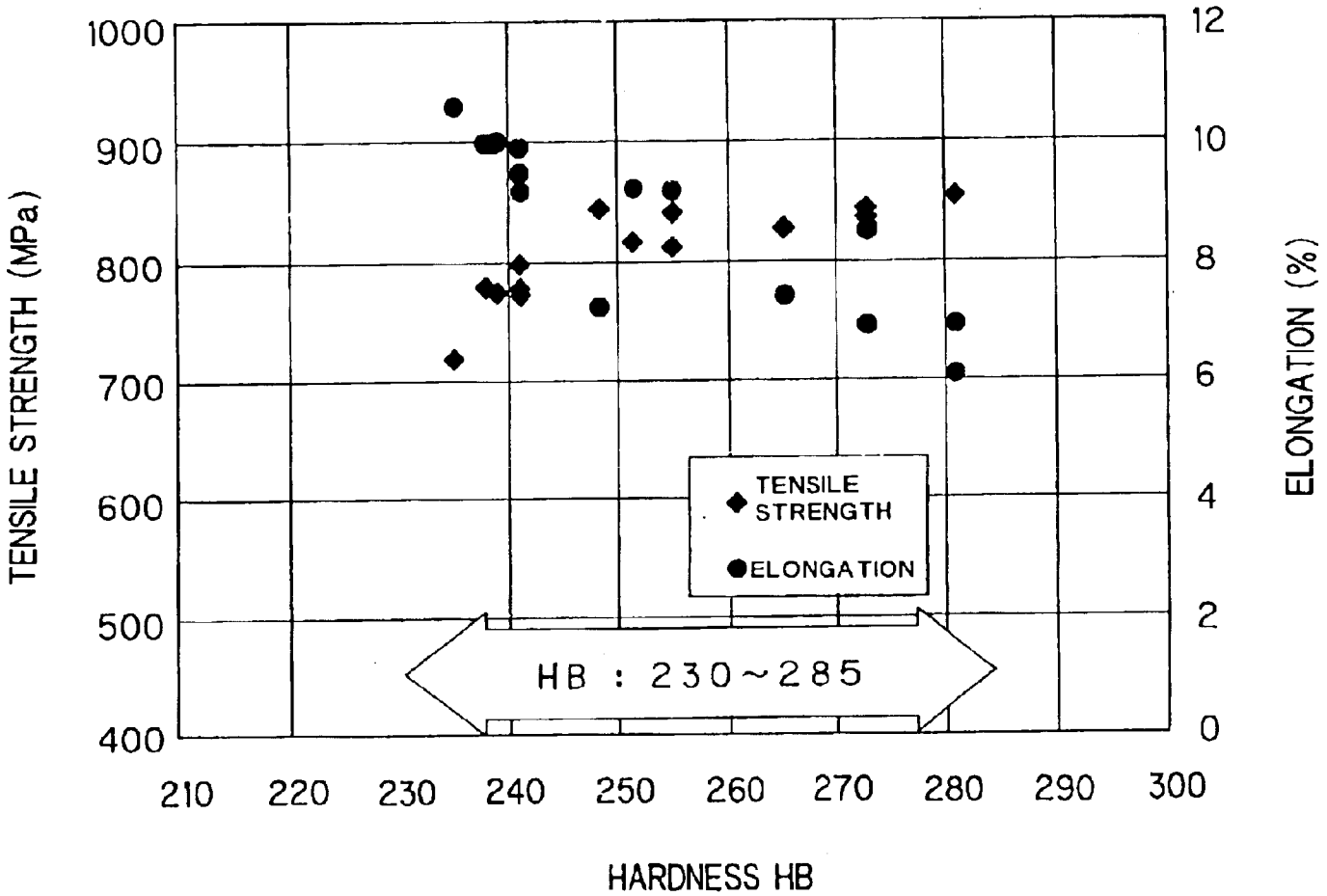
FIG. 6 is a graph showing a relationship between hardness and tensile strength/elongation.

A Y-shaped test material (B size) was obtained from spheroidal graphite cast iron molten metals having many various composition in ranges of 0.05–0.45% by mass of Mn, 2.0–4.0% by mass of Ni, 3.1–4.0% by mass of C, 1.8–3.0% by mass of Si, 0.05% by mass or less of P, 0.02% by mass or less of S, 0.02–0.06% by mass of Mg, and the rest of Fe and measured for tensile properties (tensile strength and elongation) in the same manner as in Example 1 and hardness. The results are shown in FIG. 6.

EXAMPLE 4

Figure 7:
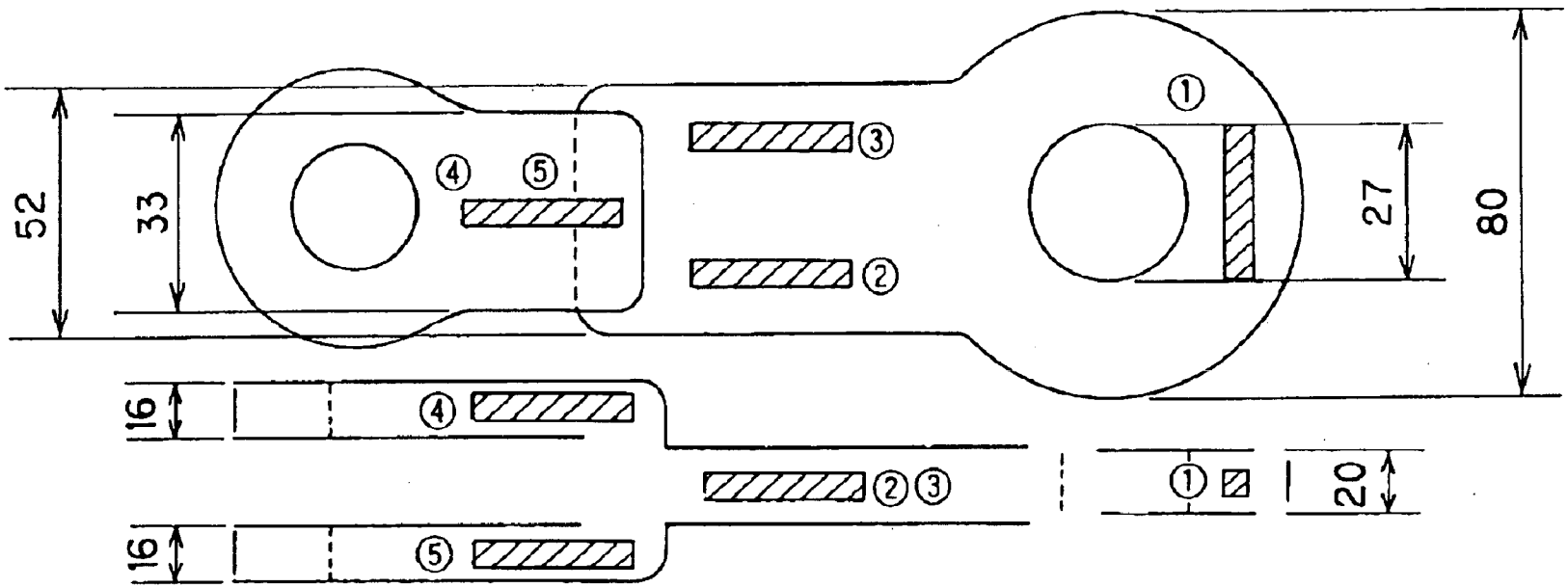
FIG. 7 is an explanatory view showing a link of an electric power product.
Figure 8A:
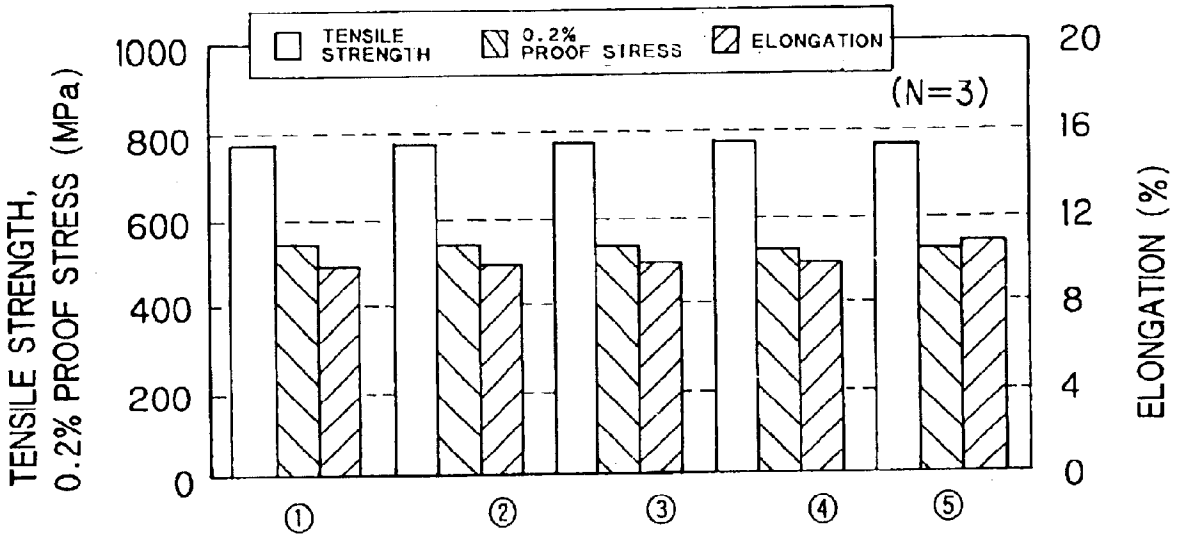
FIGS. 8(*a*) and 8(*b*) are graphs showing tensile properties (tensile strength, 0.2% proof stress and elongation) before and after the plating treatment.
Figure 8B:
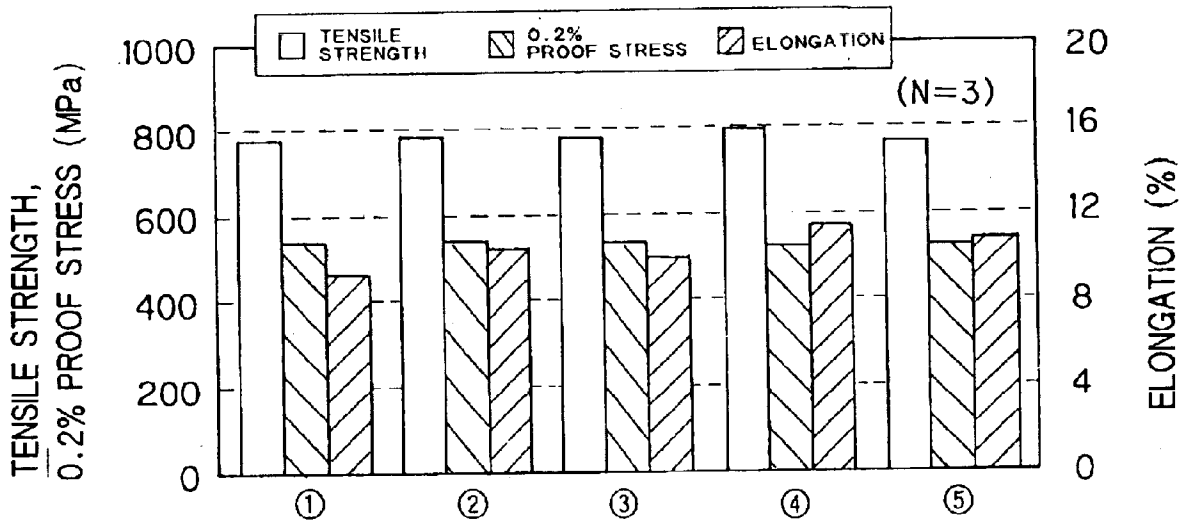

A link of an electric power product shown in FIG. 7 was measured for tensile properties (tensile strength, 0.2% proof stress and elongation) in the same manner as in Example 1. Test pieces were taken at the sites of ①, ②, ③, ④, and ⑤ of FIG. 7. The results are shown in FIG. 8(*a*).

EXAMPLE 5

The same link as in Example 4 was subjected to molten zinc plating (kept for 120 sec. at 460° C.) and measured for tensile properties (tensile strength, 0.2% proof stress and elongation). The results are shown in FIG. 8(*b*).

As a result, it was confirmed that tensile properties has almost no difference between a like before plating and one after plating.

EXAMPLE 6

Figure 9:
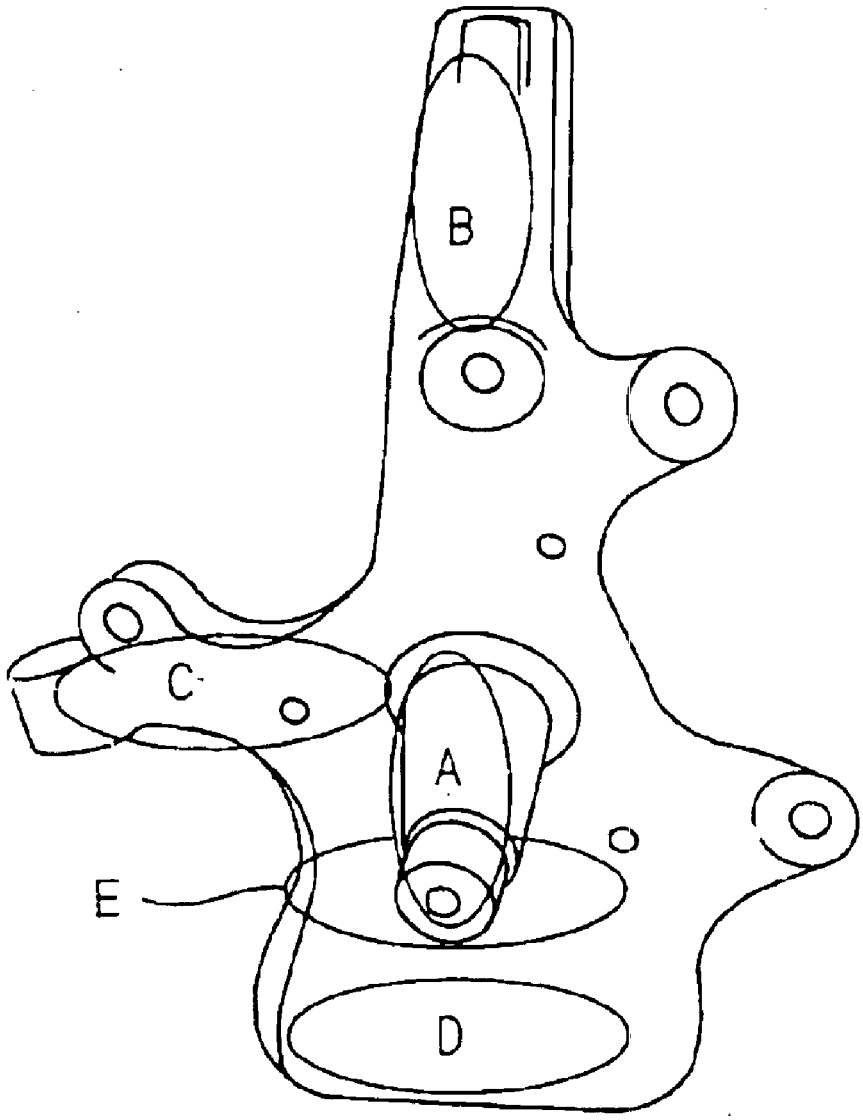
FIG. 9 is an explanatory view showing a wheel-supporting part of an automobile product.
Figure 10:
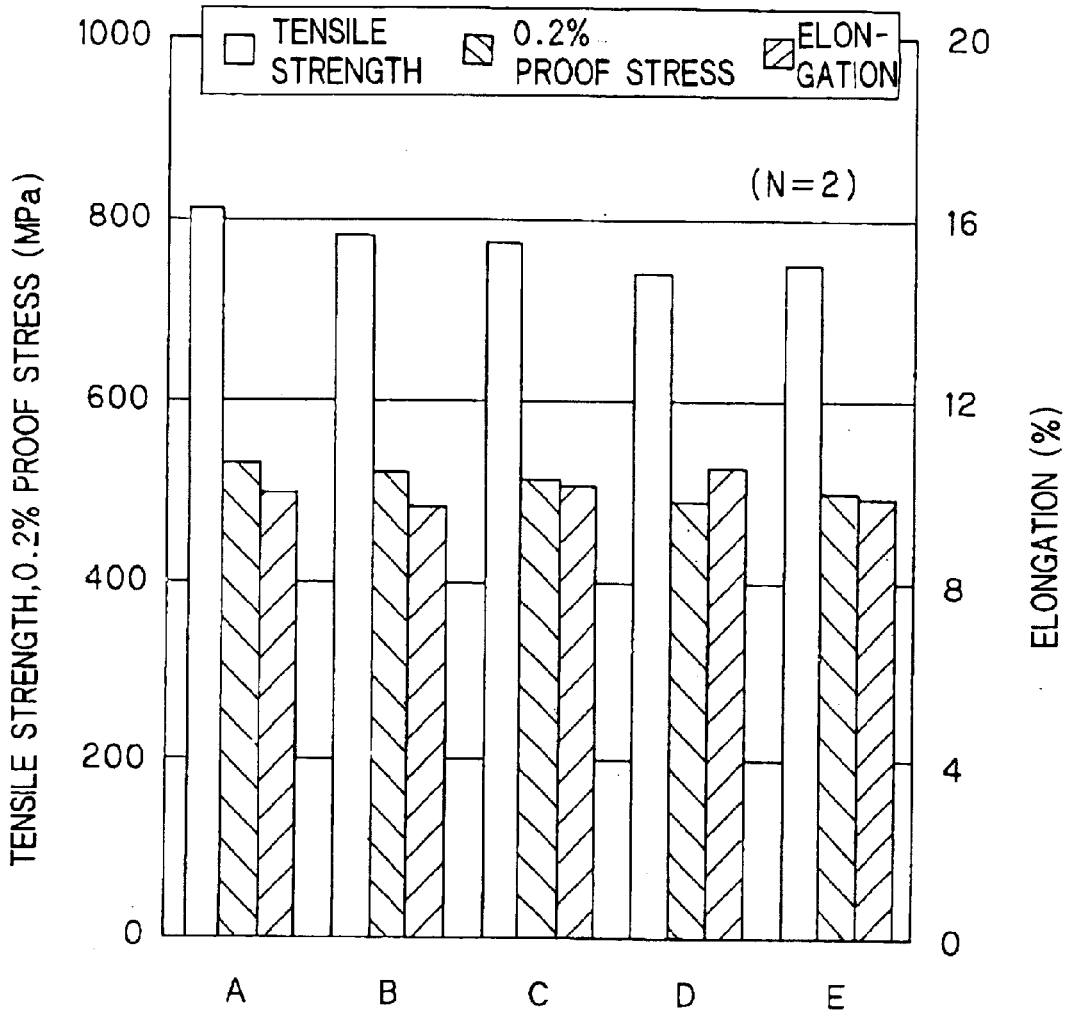
FIG. 10 is a graph showing tensile properties (tensile strength, 0.2% proof stress and elongation) in Example 6.

A wheel-supporting part of an automobile product shown in FIG. 9 was measured for tensile properties (tensile strength, 0.2% proof stress and elongation). Test pieces were taken at the sites of A, B, C, D, and E of FIG. 9. The results are shown in FIG. 10.

COMPARATIVE EXAMPLE 1

A Y-shaped test material (B size) was cast in the same manner as in Example 1 except for 0.53% by mass of Mn among molten metal compositions of the spheroidal graphite cast iron, and test pieces were taken in the same manner to be measured for tensile strength and elongation.

As a result, the elongation is lowered down to 6% or less though the tensile strength was increased to 850–900 MPa.

DISCUSSION

As is clear from the results of Examples 1, 4–6, and Comparative Example 1, spheroidal graphite cast iron obtained in Examples 1, and 4–6 have a tensile strength of 760–800 MPa, a 0.2% proof stress of 500 MPa or more, and an elongation of 7.0% or more and shows that it has expected mechanical properties. In addition, there is obtained a high value of 295 MPa of fatigue limit under a condition of $10^7$times of repetition of V-notch material obtained in Example 1.

Further, as understood from Example 2, spheroidal graphite cast iron of the present invention is excellent in workability, has a predetermined hardness of 230–285 HB and well-balanced mechanical properties in addition to high strength and high tenacity.

Industrial Applicability

As described above, spheroidal graphite cast iron of the present invention can be obtained without being subjected to an austemper treatment. The spheroidal graphite cast iron has well-balanced mechanical properties both in tensile strength and elongation, and high strength and high tenacity with tensile strength and elongation being more improved than conventional one. Further, spheroidal graphite cast iron of the present invention does not deteriorate in mechanical properties even if it is subjected to hot dipping or the like, and tensile strength and elongation can be improved without Mo being added therein. Therefore, spheroidal graphite cast iron of the present invention can be preferably adapted to electric products such as links or automobile parts such as wheel-supporting parts.

What is claimed is:

1. A non-austemper-treated spheroidal graphite cast iron obtainable without being subjected to an austemper treatment, characterized in that the non-austemper-treated spheroidal graphite cast iron has a tensile strength of 650–850 MPa and an elongation of 7.0–14.5%, wherein the spheroidal graphite cast iron consists essentially of 0.05 to 0.45% by mass Mn, 2.0 to 4.0% by mass Ni, 3.1 to 4.0% by mass C, 1.8 to 3.0% by mass Si, up to 0.05% by mass P, up to 0.02% by mass S, 0.02 to 0.06% by mass Mg, and the balance Fe.

2. A non-austemper-treated spheroidal graphite cast iron obtained without being subjected to an austemper treatment according to claim 1, characterized in that V-notch material has a fatigue limit of 290 MPa or more.

3. A non-austemper-treated spheroidal graphite cast iron according to claim 1, wherein the non-austemper-treated spheroidal graphite cast iron contains 0.1 to 0.35% by mass of Mn.

4. A non-austemper-treated spheroidal graphite cast iron according to claim 1, wherein the non-austemper-treated spheroidal graphite cast iron has a Brinell hardness of 230 to 285 HB.

5. A non-austemper-treated spheroidal graphite cast iron according to claim 2, wherein the non-austemper-treated spheroidal graphite cast iron has a Brinell hardness of 230–285 HB.

6. A non-austemper-treated spheroidal graphite cast iron according to claim 3, wherein the non-austemper-treated spheroidal graphite cast iron has a flank wear of 0.13 mm or less in a cutting distance of 1.7 km.

7. A non-austemper-treated spheroidal graphite cast iron according to claim 2, wherein the non-austemper-treated spheroidal graphite cast iron contains 0.1 to 0.35% by mass of Mn.

8. A non-austemper-treated spheroidal graphite cast iron according to claim 7, wherein the non-austemper-treated spheroidal graphite cast iron has a flake wear of 0.13 mm or less in a cutting distance of 1.7 km.

9. A non-austemper-treated spheroidal graphite cast iron according to claim 1, wherein the non-austemper-treated spheroidal graphite cast iron has a flank wear of 0.13 mm or less in a cutting distance of 1.7 km.

10. A non-austemper-treated spheroidal graphite cast iron according to claim 2, wherein the non-austemper-treated spheroidal graphite cast iron has a flank wear of 0.13 mm or less in a cutting distance of 1.7 km.

* * * * *